US007383899B2

(12) United States Patent
Beach et al.

(10) Patent No.: US 7,383,899 B2
(45) Date of Patent: Jun. 10, 2008

(54) SPEARHEAD ASSEMBLY

(75) Inventors: Andrew Beach, Perth (AU); Gavin McLeod, Perth (AU)

(73) Assignee: 2iC Australia Pty Ltd, Perth, Western Australia ( * ) Notice: Subject to any disclaimer, the term of this patent is extended or adjusted under 35 U.S.C. 154(b) by 359 days.

(21) Appl. No.: 10/525,188

(22) PCT Filed: Aug. 18, 2003

(86) PCT No.: PCT/AU03/01046

§ 371 (c)(1),
(2), (4) Date: Feb. 22, 2005

(87) PCT Pub. No.: WO2004/018831

PCT Pub. Date: Mar. 4, 2004

(65) Prior Publication Data

US 2005/0269138 A1 Dec. 8, 2005

(30) Foreign Application Priority Data

Aug. 21, 2002 (AU) ..... 2002950911

(51) Int. Cl.
*E21B 25/14* (2006.01)

(52) U.S. Cl. ..... 175/246

(58) Field of Classification Search ..... None
See application file for complete search history.

(56) References Cited

U.S. PATENT DOCUMENTS

| | | | | |
|---|---|---|---|---|
| 3,556,214 | A * | 1/1971 | Kellner | 166/98 |
| 4,281,725 | A * | 8/1981 | Runk | 175/246 |
| 6,045,171 | A * | 4/2000 | McLeod et al. | 294/86.1 |
| 6,089,335 | A * | 7/2000 | Able | 175/246 |
| 6,708,784 | B1 * | 3/2004 | Borg | 175/58 |

FOREIGN PATENT DOCUMENTS

| | | |
|---|---|---|
| WO | WO 97/08379 | 3/1997 |
| WO | WO 97/18382 | 5/1997 |

* cited by examiner

*Primary Examiner*—Frank Tsay
(74) *Attorney, Agent, or Firm*—Fish & Richardson P.C.

(57) ABSTRACT

A spearhead assembly (10) comprises a base (12) provided with a slot (14) at one end (16) which opens onto an outer surface (13) of the base (12). The outer surface (13) is composed of three contiguous surface portions (18, 20 and 22). A spearpoint (20) is pivotally coupled at its proximal end (26), which is disposed in the slot (14), to the base (12). A distal end (28) of the spearpoint (24) extends or projects beyond the slot (14) and the surface (13) of the base (12). A spearpoint positioning system (30) urges the spearpoint (24) toward one of three annually spaced positioned. These positions are characterised by the spearpoint (24) extending substantially perpendicular to parallel opposed edges of the slot (14) which open onto, or are flanked by, the surface portions (18), (20 and 22). Moving the spearpoint from one position to another requires the application of an external force.

10 Claims, 4 Drawing Sheets

SPEARHEAD ASSEMBLY

FIELD OF THE INVENTION

The present invention relates to a spearhead assembly of the type used in mining applications for coupling downhole equipment to a wireline for lowering equipment down a drill hole, drill string or casing and subsequently retrieving the equipment.

BACKGROUND OF THE INVENTION

In various areas of downhole drilling, for example core drilling, a spearhead assembly is attached to a downhole tool to facilitate connection of that tool to an overshot which in turn is attached to a wireline. This allows the tool to be lowered into a drill hole and subsequently retrieved.

The spearhead assembly has a base in the shape of a squat cylindrical having a diametrically extending slot at one end in which one end of spearpoint is pivotally coupled. An opposite end of the spearpoint is configured for releasable latching to the overshot. When connecting a spearhead assembly to an overshot above ground, an operator can easily align the spearpoint and the overshot to ensure coupling. The tool can then be lowered through the drill string by virtue of the coupling of the overshot to the spearhead assembly. When the tool has reached the desired location, the overshot can be decoupled from the spearhead assembly and withdrawn from the drill string to allow drilling to proceed. When it is necessary to withdraw the tool from the drill string, the overshot is again lowered into the drill string for coupling with the spearhead assembly.

The downhole coupling of the overshot and the spearhead assembly is generally reliable. However due to its pivot coupling, from time-to-time the spearpoint can become locked against an internal surface of the drill string and thus cannot be engaged by the overshot to allow withdrawal of the tool. In this instance, it is necessary to withdraw the entire drill string in order to retrieve the tool.

OBJECT OF THE INVENTION

The present invention was developed with a view to further increase the reliability of downhole coupling between a spearhead assembly and an overshot.

SUMMARY OF THE INVENTION

According to the present invention there is provided a spearhead assembly comprising:

- a base having an outer surface composed of a plurality of contiguous surface portions where mutually adjacent surface portions lie in, or have, relatively inclined planes or relatively inclined tangential planes;
- a slot formed in one end of said base and opening onto said plurality of surface portions;
- a spearpoint having a proximal end located in said slot and pivotally coupled to said base and a distal end projecting from said slot and beyond said surface portions; and,
- a spearpoint positioning system for urging said spearpoint toward one of a plurality of angularly spaced positions, respective ones of said positions characterised by said spearpoint extending perpendicular to the plane or tangential plane of an adjacent surface portion.

According to a further aspect of the present invention there is provided a spearpoint assembly comprising:

- a base having an outer surface;

- a slot formed in one end of said base, said slot comprising a plurality of continuous lengths each of which opens onto said outer surface, and where mutually adjacent lengths of said slot lie in respective inclined planes;
- a spearpoint having a proximal end located in said slot and pivotally coupled to said base and a distal end projecting from said slot and beyond said outer surface; and,
- a spearpoint positioning system for urging said spearpoint into one of a plurality of angularly spaced positions in which said spearpoint extends perpendicularly to the plane of the length of said slot from which said spearpoint extends.

Preferably said spearpoint positioning system comprises a plate through which said spearpoint extends, said plate retained on said spearpoint in a position where said plate contacts said outer surface.

Preferably said spearpoint positioning system further comprises a biasing device which urges said spearpoint into said one of a plurality of positions and holds said spearpoint in said one of a plurality of positions.

Preferably said biasing device biases said plate against said outer surface.

Preferably said plurality of contiguous surface portions comprises a first surface which lies in a plane substantially perpendicular to a longitudinal axis of said base, whereby when said plate lies against said first surface, said spearpoint is in a first position where it extends substantially parallel to said longitudinal axis.

Preferably said first surface is planar.

Preferably said plurality of surface portions comprises a second surface, said second surface formed about said longitudinal axis, whereby when said plate lies against said second surface, said spearpoint is in a second position extending substantially perpendicular to said longitudinal axis.

Preferably said plurality of surface portions comprises a third surface located between said first and second surfaces, said third surface configured so that when said plate lies against said third surface, said spearpoint is in a third position angularly spaced between said first and second positions.

Preferably said third surface is configured so that when said spearpoint is in said third position, said spearpoint extends at substantially 45° to said longitudinal axis.

Preferably said plurality of lengths comprise a first length which lies in a first plane which is perpendicular to a longitudinal axis of said base, whereby when said plate lies against said first length said spearpoint is in a first position extending substantially parallel to said longitudinal axis.

Preferably said plurality of lengths comprise a second length which is parallel to said longitudinal axis, whereby when said plate lies against said second length, said spearpoint is in a second position extending substantially perpendicular to said longitudinal axis.

Preferably said plurality of lengths comprise a third length located between said first and second lengths, whereby when said plate lies against said third length, said spearpoint is in a third position angularly spaced between said first and second positions.

Preferably said third length lies in a third plane which extends at substantially 45° to said longitudinal axis.

Preferably said spear positioning system is arranged so that when said spearhead assembly is disposed within a drill string, said positioning system urges said spearpoint to said first position.

In one embodiment, said plate has a peripheral edge which is substantially co-extensive with a peripheral edge of said first surface when said plate is parallel to said first surface.

However in a alternate embodiment, said plate may have a peripheral surface which extends to, or beyond, said second surface when said plate is parallel to said first surface.

According to the present invention there is provided a spearhead assembly comprising:

a base provided with a slot at a first end, said slot opening onto a plurality of sequentially contiguous outer surface portions of said base;

a spearpoint having a proximal end pivotally coupled to the base and disposed in said slot, and a distal end extending beyond said base; and, a spearpoint positioning system for urging said spearpoint toward one of a plurality of angularly spaced positions related to said surface portions.

Preferably each of said plurality of positions is characterised by said spearpoint extending substantially perpendicular to a plane containing parallel opposite edges of said slot flanking respective ones of said surfaces.

BRIEF DESCRIPTION OF THE DRAWINGS

An embodiment of the present invention will now be described by way of example only with reference to the accompanying drawings in which.

DETAILED DESCRIPTION OF PREFERRED EMBODIMENT

Figure 1:
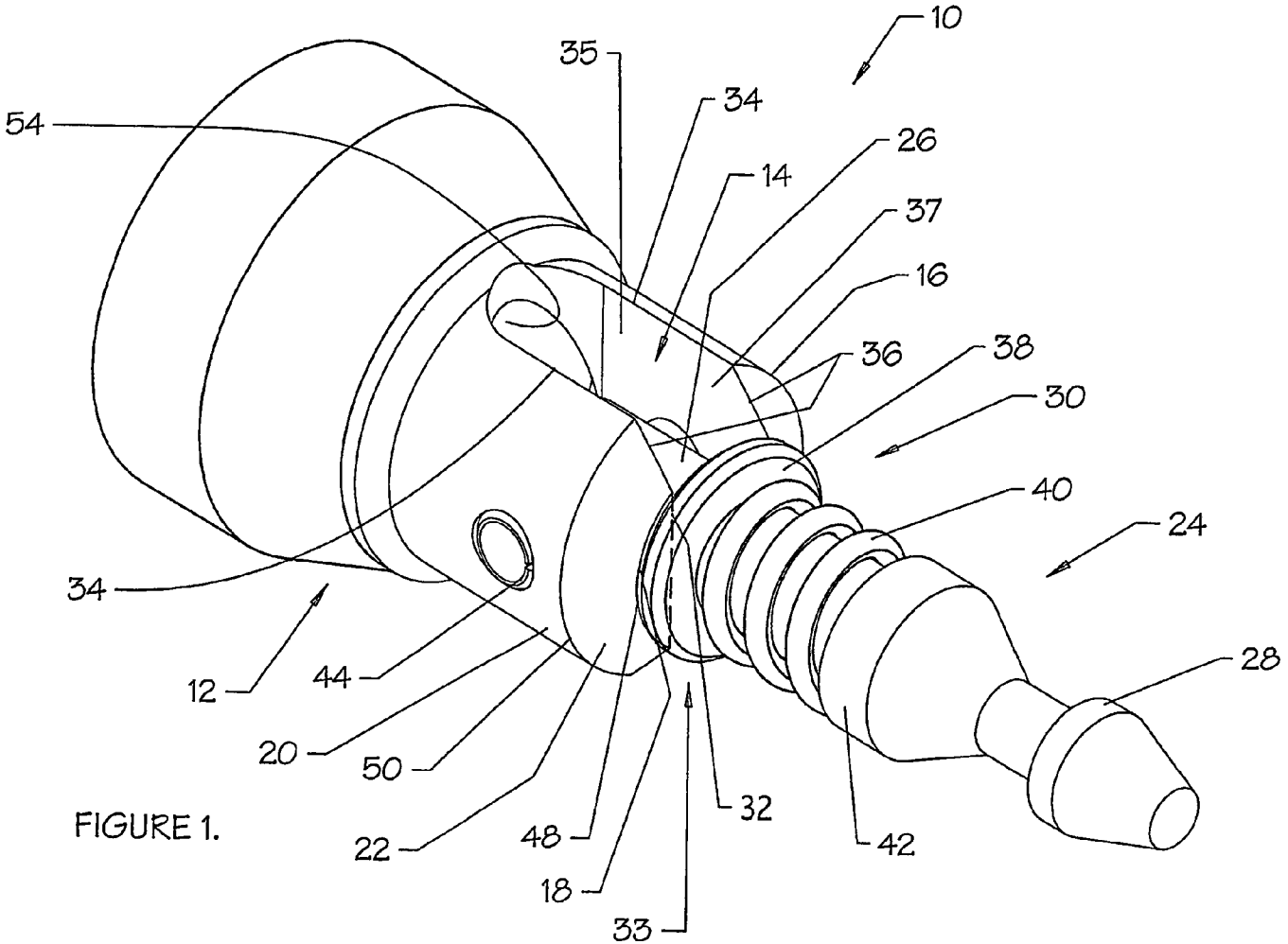
FIG. 1 is a perspective view of an embodiment of the spearhead assembly viewed from the side.
Figure 2:
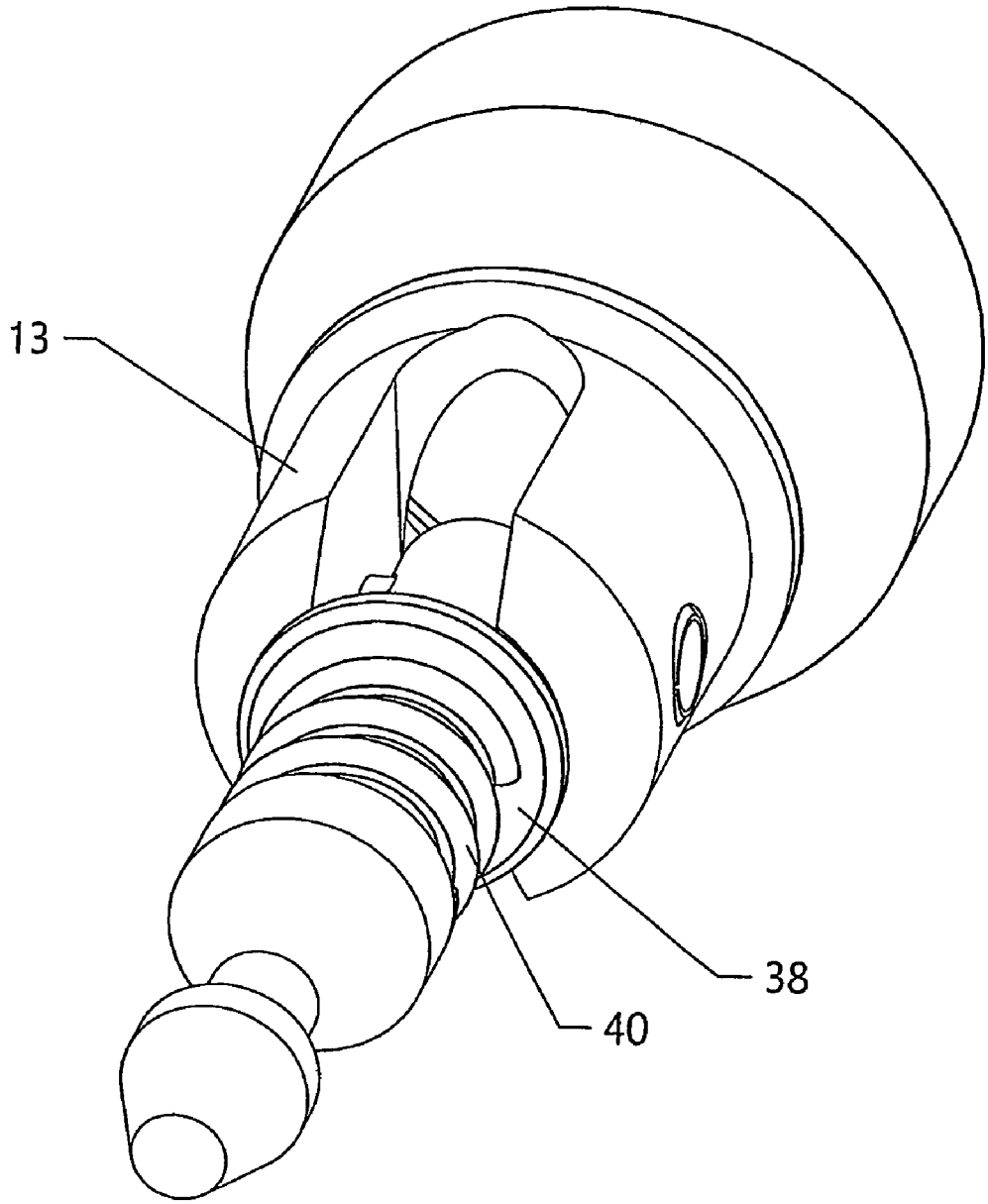
FIG. 2 is a perspective of the spearhead assembly viewed from the front.

Referring to the accompanying drawings, a spearhead assembly 10 in accordance with an embodiment of this invention comprises a base 12 provided with a slot 14 at a first end 16 which opens onto an outer surface 13 of the base 12 which includes a plurality (in this instance three) of contiguous surface portions 18, 22 and 20 of the base 12. A spearpoint 24 is pivotally coupled at its proximal end 26, which is disposed in the slot 14, to the base 12. A distal end 28 of the spearpoint 24 extends or projects beyond the slot 14 and surface 13 of the base 12. The spearhead assembly 10 includes a spearpoint positioning system 30 for urging the spearpoint 24 toward a selected one of a plurality (in this case, three) of angularly spaced positions. These positions are characterised by the spearpoint 24 extending substantially perpendicular to parallel opposite edges of the slot 14 which open onto or are flanked by the surface portions 18, 20 and 22. For example, in FIGS. 1-3, the spearpoint positioning system 30 urges the spearpoint 24 in a first position where the spearpoint 24 extends perpendicular to the plane containing parallel opposite edges 32 (only one shown) of the slot 14 which open onto or are flanked by the surface 18. Thus, in this position, the spearpoint 24 extends perpendicular to the plane containing the surface 18, and parallel to a longitudinal axis A of the base 12. The edges 32 may be considered to define a first length 33 of the slot 14.

Figure 4:
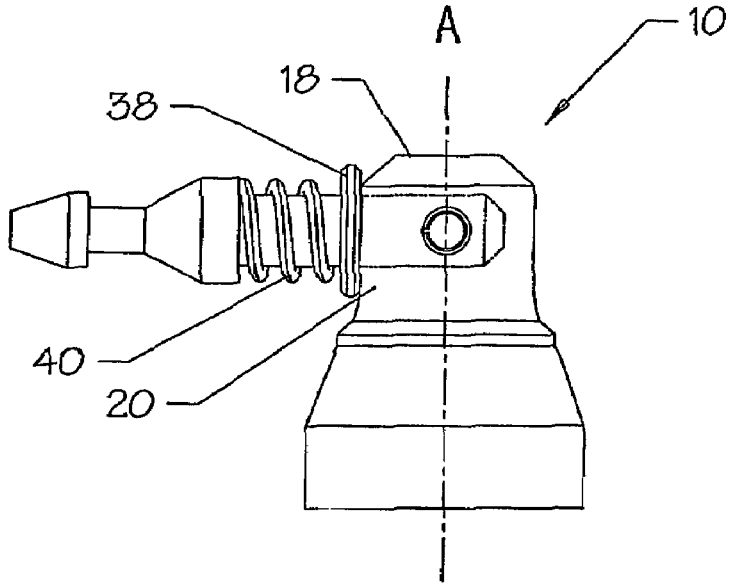
FIG. 4 is a side view of the spearhead assembly with the spearpoint in a second position; and, FIG. 5 is a side view of the spearhead assembly with the spearpoint in a third position.

The slot 14 further comprises two pairs of opposed edges 34 which open onto or are flanked by the surface portion 20. Any one of these pairs of edges 34 may be considered as defining a second length 35 of the slot 14. The spearpoint positioning system 30 urges the spearpoint 24 in a position where it extends perpendicular to the edges 34 as depicted in FIG. 4, ie substantially perpendicular to the longitudinal axis A. This may be considered as a second position for the spearpoint 24. (A symmetrical second position exists on the opposite side of the slot 14, i.e. where, with reference to FIG. 4, the spearpoint 24 is rotated 180° about its pivot point.) Thus in this second position the spearpoint 24 extends perpendicular to a tangential plane of the surface portion 20.

The slot 14 further comprises two pairs of opposed edges 36 which open onto the third surface portion 22. The pair of edges 36 adjacent the pair of edges 34 which from the second length of the slot 14 may be considered as defining a third length 37 of the 14. Again, the spearpoint positioning system 30 can hold the spearpoint 24 in a third position depicted in FIG. 5 where it extends substantially perpendicular to a plane containing the edges 36 and length 37. In this instance, as the surface 22 tapers at an angle of 45° to the axis A, this coincides with the spearpoint 24 extending at an angle of 45° to the axis A. (A symmetrical third position exists on the opposite side of the slot, i.e. where, with reference to FIG. 5 the spearpoint is rotated by 90° clockwise.)

The spearpoint positioning system 30 includes a plate 38 in the form of a disc shaped washer and a biasing device in the form of a spring 40. The spearpoint 24 passes through the plate 38. The spring 40 acts between the plate 38 and a shoulder 42 (or like stop) machined or otherwise formed on the spearpoint 24. Thus, the spring 40 biases the plate 38 against the outer surface 13 of the base 12. More particularly, the spring 40 biases the plate 38 against one of the surface portions 18, 20 or 22 depending on the position of the spearpoint 24, to thereby hold the spearpoint in that position.

A pivot pin 44 extends transversely through the portion of the base 12 containing the surface portion 20, as well as passing through the proximal end 26 of the spearpoint 24. In this way the pivot pin 44 pivotally couples the spearpoint 24 to the base 12 in a manner so that it can pivot about an axis co-linear with the pivot pin 44.

The spring 40 is pre-compressed so that it continually exerts a force on the plate 38 pushing the plate 38 into contact with surface portions 18, 20 or 22.

Consequently, it would be appreciated that in order to move the spearpoint 24 between any two of its positions, a positive force must be applied in order to further compress the spring 40. Accordingly, in the absence of such a force, the spearpoint positioning system 30 tends to bias the spearhead assembly toward, and maintain the spearhead assembly in one of its above-described positions. This is in contrast with the prior art where the spearhead assembly is able to pivot freely about a pivot pin. When the spearhead assembly 10 is attached to a downhole tool, and disposed within a drill pipe 46 (see FIG. 3), the system 30 will tend to maintain the spearpoint 24 in a position where it extends parallel to the longitudinal axis A thus maximising the likelihood of positive coupling with the overshot. In effect, the system 30 acts to self-centralise the spearpoint 24 when the spearhead assembly is disposed within a drill pipe 46.

Figure 3:
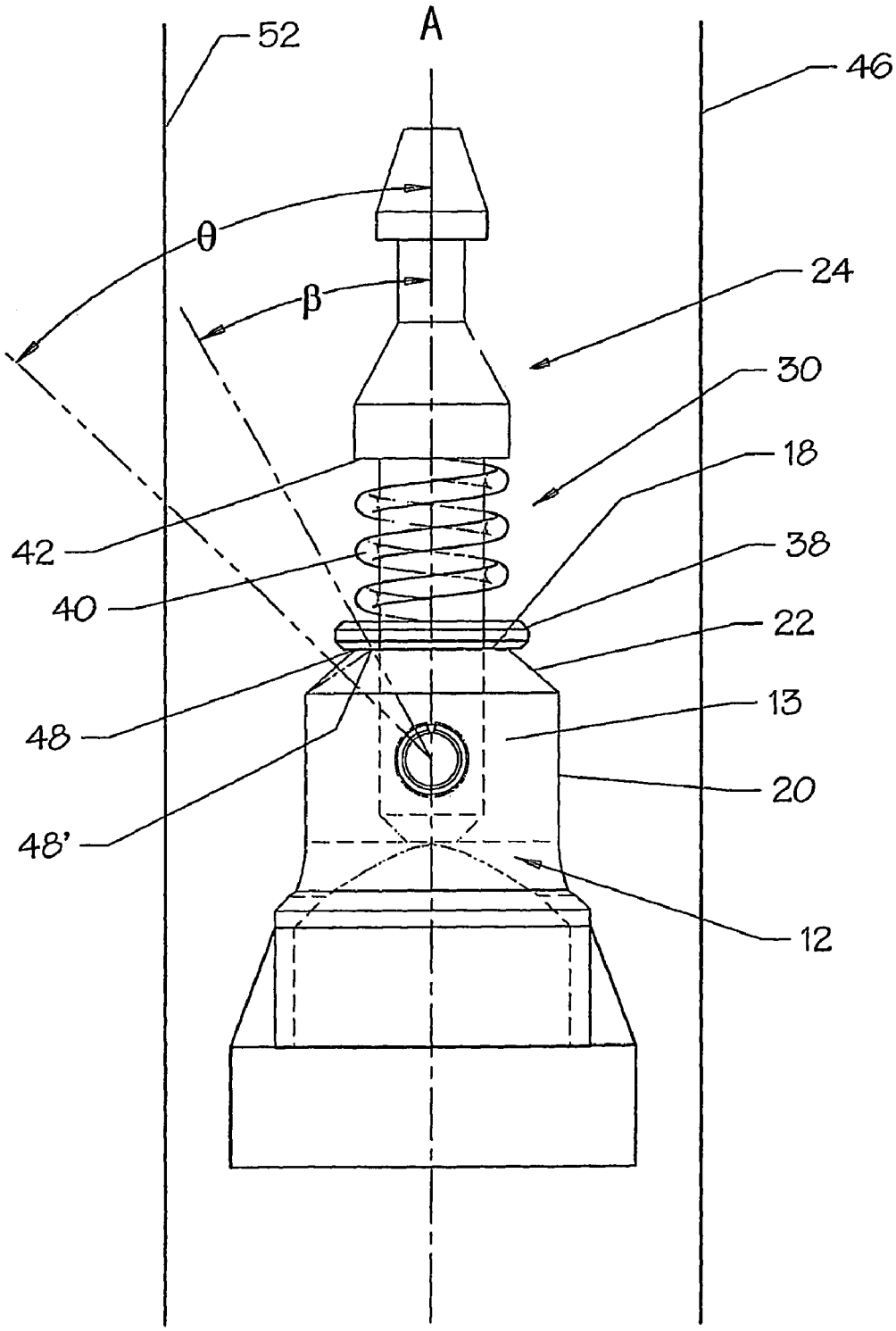
FIG. 3 is a side view of the spearhead assembly disposed within a drill pipe and a spearpoint of the spearhead assembly in a first position.

A boundary or edge 48 is formed between the first surface portion 18 and the third surface portion 22; with a further distinct boundary or edge 50 being formed between the third surface portion 22 and the second surface portion 20. The self-positioning system 30 operates to provide a "click-type" action when the spearpoint 24 is pivoted beyond these edges between its first, second and third positions. The configuration of surface portions 18, 20 and 22, location of edges 48 and 50 and size of plate 38 can be arranged to control the angle by which the spearpoint 24 must be pivoted prior to "clicking over" from one position to another. Referring to FIG. 3, edge 48 and plate 38 are related so that the spearpoint 24 must pivot through an angle θ about the pivot pin 44 of approximately 40° in order that the system 30 will hold the spearpoint 24 in its third position (shown in FIG. 5). However spearpoint 24 will contact an internal surface 52 of the drill pipe 46 prior to pivoting through the angle θ and thus the system 30 will maintain the spearpoint 24 in its first position (shown in FIG. 3) while disposed in the drill pipe 46.

Figure 5:
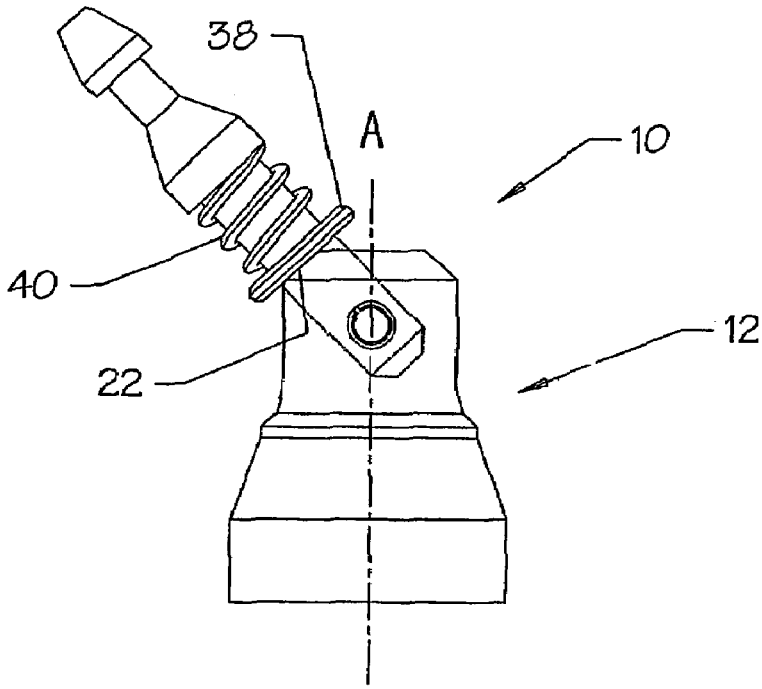

On the other hand if the surface 22 were less steeply inclined so as to move the edge 48 inwardly to a position 48' as shown in phantom on FIG. 3, then the spearpoint 24 would need to pivot through a smaller angle β in order to be clicked over the third position depicted in FIG. 5.

Hence, embodiments of the present invention provide a facility by which the angle of pivoting of the spearpoint 24 required for the system 30 to positively hold the spearhead assembly in a different position can be varied to suit the application at hand.

As previously mentioned, the angle by which the spearpoint 24 must be pivoted in order for the system 30 to change the position in which it holds the spearpoint 24 may be governed at least in part by the dimensions of the plate 38. In the present embodiments, the plate 38 is of a dimension so as to substantially overlie the surface 18 and thus has a radius substantially the same as that of the edge 48. However by extending the radius of the plate 38 outwardly to say, the diameter of the second surface portion 20 or indeed the diameter of the base 12, the spearhead assembly 10 when located within the drill pipe 46 will be effectively constrained by the system 30 so as to be held in the first position where it extends parallel to the axis A.

When outside of the drill pipe 46, the system 30 can be used to hold the spearpoint 24 in any one of the first, second or third positions as depicted in FIGS. 3, 4 and 5 respectively for various purposes including manual coupling with an overshot.

As is common in spearhead assemblies, the base is provided with an axial hole 54 which is in fluid communication with the slot 14 to allow fluid to flow through the spearhead assembly 10.

Now that an embodiment of the invention has been described in detail, it will be apparent to those skilled in the relevant arts that numerous modifications and variations may be made without departing from the basic inventive concepts. For example, the base 12 is shown as being provided with three contiguous surface portions 18, 20 and 22 onto which the slot 14 opens. However two surface portions may be provided rather than three, for example surfaces 18 and 20 only, or more than three surface portions may be provided.

Further, the spring 40 may be replaced by other bias means such as a rubber sleeve or a pneumatic cylinder. Also, the plate 38 may be provided with one or more axial holes to limit the effect of the plate 38 on the flow of fluid through the base 12.

All such variations and modifications are deemed to be within the scope of the present invention the nature of which is to be determined from the above description and the appended claims.

The invention claimed is:

1. A self-centralizing spearhead assembly for a tool passed through a drill pipe having an inner surface, comprising:

a base having a longitudinal axis and an outer surface composed of a plurality of contiguous surface portions where mutually adjacent surface portions lie in, or have, relatively inclined planes or relatively inclined tangential planes, a first of said surface portions lying in a first plane perpendicular to said longitudinal axis and a second of said surface portions lying in a second plane inclined at an acute angle to the first plane, the first plane being contiguous with the second plane;

a slot formed in one of said base and opening onto said plurality of surface portions;

a spearpoint having a proximal end located in said slot and pivotally coupled to said base and a distal end projecting from said slot and beyond said surface portions; and a spearpoint positioning system for urging said spearpoint toward one of a plurality of angularly spaced positions, respective ones of said positions characterized by said spearpoint extending perpendicular to the plane or tangential plane of an adjacent surface portion wherein a first of said positions is a central position where said spearpoint lies parallel to said longitudinal axis when said spearpoint extends perpendicular to said first plane and a second of said positions is an inclined position where said spearpoint is pivoted through an angle θ from the longitudinal axis when the spearpoint extends perpendicular to the second plane; and wherein said spearpoint is configured to contact the inner surface of the drill pipe prior to pivoting through the angle θ from the longitudinal axis, whereby the spearpoint is self maintained in the central position while disposed in the drill pipe.

2. The assembly according to claim 1, wherein said spearpoint positioning system comprises a plate through which said spearpoint extends, said plate retained on said spearpoint in a position where said plate contacts said outer surface.

3. The assembly according to claim 2, wherein said spearpoint positioning system further comprises a biasing device which urges said spearpoint into said one of a plurality of positions and holds said spearpoint ins aid one of a plurality of positions.

4. The assembly according to claim 3, wherein said biasing device biases said plate against said outer surface.

5. The assembly according to claim 2, wherein said plurality of surface portions comprises a third surface, said third surface formed about said longitudinal axis, whereby when said plate lies against said third surface, said spearpoint is in a third position extending substantially perpendicular to said longitudinal axis.

6. The assembly according to claim 5, wherein said plate has a peripheral surface which extends to, or beyond, said third surface when said plate is parallel to said first surface.

7. The assembly according to claim 2, wherein said plate has a peripheral edge which is substantially co-extensive with a peripheral edge of said first surface when said plate is parallel to said first surface.

8. The assembly according to claim 1, wherein said second surface is configured so that when said spearpoint is in said second position, said spearpoint extends at substantially 45° to said longitudinal axis.

9. The assembly according to claim 1 further comprising an axial hole formed in the base, the axial hole being in fluid communication with said slot, wherein a fluid can flow in an axial direction through said base via said slot and said axial hole.

10. The assembly according to claim 1 wherein said slot forms two spaced apart arms in said base and wherein said proximal end of said spearpoint is located between and pivotally coupled to said arms.

* * * * *